US011490691B2

(12) United States Patent
Takashima et al.

(10) Patent No.: US 11,490,691 B2
(45) Date of Patent: Nov. 8, 2022

(54) SHOE HAVING COUNTER

(71) Applicant: ASICS Corporation, Hyogo (JP)

(72) Inventors: Shingo Takashima, Hyogo (JP); Masanori Sakaguchi, Hyogo (JP); Mai Nakaya, Hyogo (JP); Tomoki Ishizashi, Hyogo (JP); Hiroaki Nishimura, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 81 days.

(21) Appl. No.: 17/253,345

(22) PCT Filed: Jan. 24, 2019

(86) PCT No.: PCT/JP2019/002246
§ 371 (c)(1),
(2) Date: Dec. 17, 2020

(87) PCT Pub. No.: WO2020/152821
PCT Pub. Date: Jul. 30, 2020

(65) Prior Publication Data
US 2021/0259364 A1 Aug. 26, 2021

(51) Int. Cl.
*A43B 23/08* (2006.01)
*A43B 23/02* (2006.01)
*A43B 7/20* (2006.01)

(52) U.S. Cl.
CPC ..... *A43B 23/088* (2013.01); *A43B 23/0275* (2013.01); *A43B 7/20* (2013.01)

(58) Field of Classification Search
CPC ..... A43B 23/088
(Continued)

(56) References Cited

U.S. PATENT DOCUMENTS 2,156,086 A * 4/1939 Hack ..... A43B 17/16 36/76 R
2,203,157 A * 6/1940 Klaus ..... A43B 13/41 36/43

(Continued)

FOREIGN PATENT DOCUMENTS

JP 2008-132227 A 6/2008
JP 2008-206629 A 9/2008
WO 2018/016382 A1 1/2018

OTHER PUBLICATIONS

International Search Report issued in corresponding International Patent Application No. PCT/JP2019/002246, dated Apr. 16, 2019, with English translation.

*Primary Examiner* — Marie D Bays
(74) *Attorney, Agent, or Firm* — McDermott Will & Emery LLP

(57) ABSTRACT

A shoe including: an upper, wherein an upper edge of a topline is defined by a medial line and a lateral line; and a counter, wherein an upper edge is defined, at a position downward of the upper edge of the topline, by first counter line on a medial side and a second counter line, which protrude downward, wherein: a medial height difference is defined by a difference in a height direction between a first point at a lowermost point on the medial line and a second point at a lowermost point on the first counter line; a lateral height difference is defined by a difference in the height direction between a third point at a lowermost point on the lateral line and a fourth point at a lowermost point on the second counter line; and the lateral height difference is greater than the medial height difference.

19 Claims, 11 Drawing Sheets

(58) Field of Classification Search
USPC ..... 36/68, 69
See application file for complete search history.

(56) References Cited

U.S. PATENT DOCUMENTS

| | | | | |
|---|---|---|---|---|
| 2,403,442 | A * | 7/1946 | Klaus | A43B 7/144 36/76 R |
| 8,677,656 | B2 | 3/2014 | Nishiwaki et al. | |
| 2008/0120871 | A1 | 5/2008 | Sato et al. | |
| 2010/0307025 | A1 | 12/2010 | Truelsen et al. | |
| 2011/0113650 | A1* | 5/2011 | Hurd | A43B 7/20 36/107 |
| 2011/0185592 | A1* | 8/2011 | Nishiwaki | A43B 23/17 36/69 |
| 2014/0202044 | A1* | 7/2014 | Adami | A43B 7/19 36/34 R |
| 2016/0007687 | A1 | 1/2016 | Surace et al. | |
| 2019/0297999 | A1* | 10/2019 | Nakaya | A43B 7/24 |

* cited by examiner (a)Medial
(b)Lateral

B
D
H
8
5
6
20
$H_N$
2
2M
2L
11
16
1
13
36
31
O6
4
O2
O1
O
21
34
O5
2B
33
15
38
32
40
$A_M$
$D_M$
12
14
37
7
O7
39
$A_L$
O3
22
$D_L$
O4
35
34B
24
L4

(a)Medial (b)Lateral

SHOE HAVING COUNTER

CROSS REFERENCE TO RELATED APPLICATIONS

This application is the U.S. National Phase under 35 U.S.C. § 371 of International Application No. PCT/JP2019/002246, filed on Jan. 24, 2019, the entire contents of each are hereby incorporated by reference.

TECHNICAL FIELD

The present invention relates to a shoe having a counter.

BACKGROUND ART

A counter for keeping the shape of the heel portion of the upper is known in the art (Patents Documents). When running and walking, the foot lands from the lateral side of the heel and pronates as if to collapse toward the medial side. At this point, the counter exerts stability and a pronation-suppressing function. During heel rise thereafter, it exerts a holding function of holding the heel so as to prevent the heel from rising off the sole inside the upper.

CITATION LIST

Patent Literature

First Patent Document: U.S. Pat. No. 8,677,656 B2
Second Patent Document: JP2008-206629 A

SUMMARY OF INVENTION

However, the counter increases the rigidity of the upper. Therefore, it may lower the foot conformity of the upper to the heel of the foot.

Therefore, it is an object of the present invention to provide a shoe having a counter, with which it is possible to enhance the stability, the pronation-suppressing function and the holding function and to improve the foot conformity of the upper to the heel.

The principle of the present invention will be described with reference to FIG. 6.

FIG. 6(*a*) is a perspective view of the right foot as seen from a diagonally rearward angle, and FIG. 6(*b*) is a perspective view of the right foot and the bone structure as seen from another diagonally rearward angle. FIGS. 6(*c*) and 6(*d*) are each a perspective view of the right foot as seen from a diagonally forward direction.

With the ankle of the foot, the lateral ankle $A_L$ on the lateral side is located downward of the medial ankle $A_M$ on the medial side. There is a protrusion called the sustentaculum tali (calcaneus bulge) $A_B$, etc., on the medial side of the heel of FIG. 6(*b*), and there is a slightly bulging portion F1 on the medial side of FIG. 6(*a*). On the other hand, on the lateral side of the heel of FIG. 6(*a*), there is a narrowed portion F2, which is narrowed between the lateral ankle $A_L$ and the sole of the foot, on the diagonally rearward side of the lateral ankle $A_L$. The lateral side of the heel from the sole of the foot to the narrowed portion F2 is tapered toward the upward side.

Therefore, the shape and structure being equal on the medial side and on the lateral side, as with conventional ordinary counters, will cause the foot conformity of the upper in the counter portion to lower either on the medial side or on the lateral side.

Solution to Problem

In a first aspect, a shoe according to the present invention includes an upper 2, wherein an upper edge of a topline (a wearing opening) 20 is defined by a medial line 21 and a lateral line 22 define, and a counter 1. An upper edge of the counter 1 is defined, at a position downward of the upper edge of the topline 20, by a first counter line 11 on the medial side and a second counter line 12 on the lateral side, which protrude downward D. A medial height difference $H_M$ is defined by a difference in a height direction between a first point O1 at a lowermost point on the medial line 21 and a second point O2 at a lowermost point on the first counter line 11. A lateral height difference $H_L$ is defined by a difference in the height direction between a third point O3 at a lowermost point on the lateral line 22 and a fourth point O4 at a lowermost point on the second counter line 12. The lateral height difference $H_L$ is greater than the medial height difference $H_M$.

Herein, in the first aspect, the lateral height difference $H_L$ is greater than the medial height difference $H_M$, and the second counter line 12 on the lateral side will therefore be arranged downward of the first counter line 11 on the medial side. Thus, the counter on the lateral side, of which the second counter line 12 is arranged downward, will be more likely to be in contact with a portion downward of the narrowed portion F2 on the lateral side, and will make it more likely for the upper to fit to the lateral side of the heel.

In the present specification, the medial line and the lateral line refer to a line on the medial side and a line on the lateral side of a topline that defines the topline (a wearing opening) 20, and these lines are continuous with each other on the rear end side of the upper. The medial side and the lateral side refer to respective portions that cover the medial side and the lateral side of the foot and that are visible on the medial and lateral side views of the upper. The first counter line 11 and the second counter line 12, which define the upper edge of the counter, refer to lines that are obtained by connecting together in the front-rear direction the uppermost points on the cross sections of the medial and lateral counters. Therefore, the counter portion is present directly below each counter line and no counter portion is present directly above each counter line.

In a second aspect, a shoe according to the present invention includes an upper 2, a sole attached to the upper 2, and a counter 1. On the medial side and on the lateral side, the upper 2 has a medial line 21 and a lateral line 22, which define the upper edge of a topline 20 and which protrude downward D. The counter 1 includes a heel portion 15 that extends upward from the sole 4 at a position downward of the rear portion of the topline 20 and is arranged on the medial side, the back side and the lateral side of the upper 2. The counter 1 includes movable portions 16 on the medial side and on the lateral side extending in a diagonal forward and upward direction from the heel portion 15 at a position downward of the front portion of the topline 20 on the medial side and on the lateral side. On the medial side and on the lateral side, an upper edge of the counter 1 is defined by a first counter line 11 and a second counter line 12 that protrude downward D and that extend along the medial line 21 and the lateral line 22, respectively. A medial height difference $H_M$ is defined by a difference in a height direction between a first point O1 at a lowermost point on the medial line 21 and a second point O2 at a lowermost point on the first counter line 11. A lateral height difference $H_L$ is defined by a difference in the height direction between a third point O3 at a lowermost point on the lateral line 22 and a fourth point O4 at a lowermost point on the second counter line 12. The third point O3 at the lowermost point is arranged downward D relative to the first point O1 at the lowermost point. The lateral height difference $H_L$ is greater than the medial height difference $H_M$.

In this aspect, the heel portion will help maintain the state where the heel is held by the upper, and will exert the stability and the holding function mentioned above.

On the other hand, the movable portions extending from the heel portion in a diagonal forward and upward direction are pulled by a shoelace, or the like, toward each other so as to conform to the side surfaces of the foot, and will improve the foot conformity of the upper realized by the counter.

For an ordinary adult male, the lateral ankle is said to be located downward of the medial ankle by 7 mm or more and rearward of the medial ankle by 12 mm or more. In this aspect, with the third point O3 arranged downward D relative to the first point O1, it is possible to prevent the lateral line 22 from interfering with the lateral ankle at a position lower than the medial ankle. Moreover, with the medial height difference $H_M$ being smaller than the lateral height difference $H_L$, there is a more enhanced function, realized by the counter 1, of supporting the side surface of the foot on the medial side than on the lateral side. Therefore, there will be a more enhanced function of suppressing the pronation in which the foot collapses toward the medial side. Particularly, the lateral height difference $H_L$ is greater than the medial height difference $H_M$. The third point O3 is arranged downward relative to the first point O1, and the fourth point O4 of the counter is arranged at a position that is more distantly downward from the third point O3. Therefore, the height from the lateral ankle to the second counter line 12 on the lateral side is large. Thus, the counter does not face the bulge of the lateral ankle. Therefore, it will be even more likely for the counter on the lateral side at a position downward of the lateral ankle to conform to a portion that is downward relative to the narrowed portion F2. As a result, on the lateral side, the foot conformity of the counter 1 will be even better.

In contrast, counters known in the art are formed with the shape and size being equal on the medial side and on the lateral side. Therefore, when a known counter is applied to athletic shoes, the medial height difference $H_M$ is large and the lateral height difference $H_L$ is small. With such a structure, on the medial side, the portion to be supported by the counter 1 is insufficient, thereby failing to sufficiently suppress collapse of the foot toward the medial side. On the lateral side, the second counter line 12 is too close to the lateral ankle, and the foot conformity of the counter 1 will be poor.

A shoe according to the present invention, in a third aspect, includes an upper 2 defining a topline 20, and a counter 1. An upper edge of the counter 1 is defined, at a position downward of the upper edge of the topline 20, by a first counter line 11 on the medial side and a second counter line 12 on the lateral side, which protrude downward D. The fourth point O4 at the lowermost point on the second counter line 12 is arranged downward relative to the second point O2 at the lowermost point on the first counter line 11. The fourth point O4 is arranged at a position that is within 15% from a rear end 24 of an inside of the upper 2 with respect to an entire length of a sock liner (a sock lining) 7 accommodated in the upper.

In this aspect, the fourth point O4 at the lowermost point on the counter line 12 on the lateral side is arranged at a position that is within 15% from the rear end, and it is located rearward relative to the lateral ankle when the foot is inserted into the shoe. Therefore, a portion of the upper that is rearward relative to the lateral ankle will be likely to conform to the foot on the lateral side.

Figure 1:
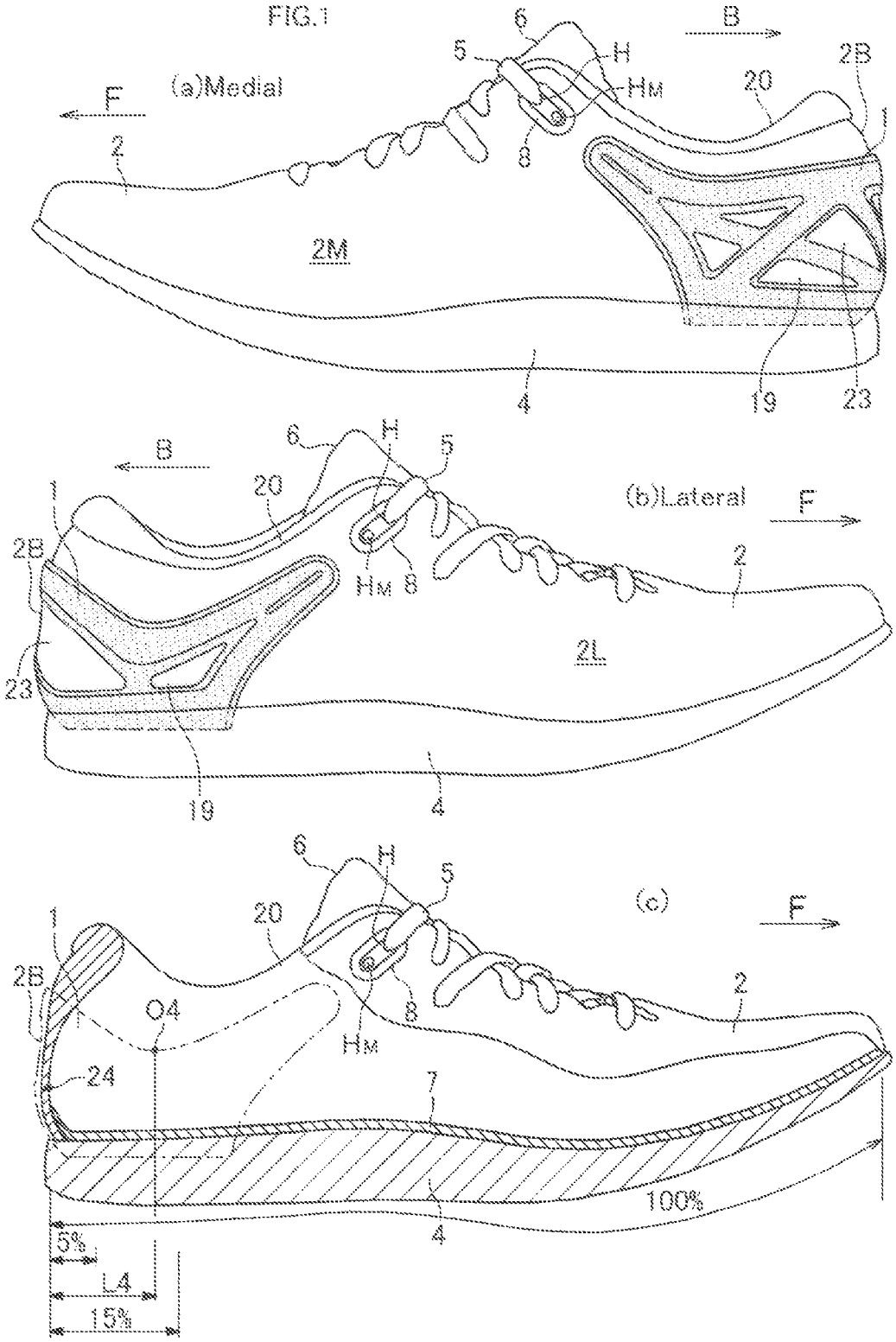
FIGS. 1(*a*) and 1(*b*) are a medial side view and a lateral side view, respectively, of a shoe representing Embodiment 1 of the present invention, and FIG. 1(*c*) is a partial longitudinal section of the shoe showing a sock lining.

Note that in FIG. 1, the counter is dotted.

Figure 2:
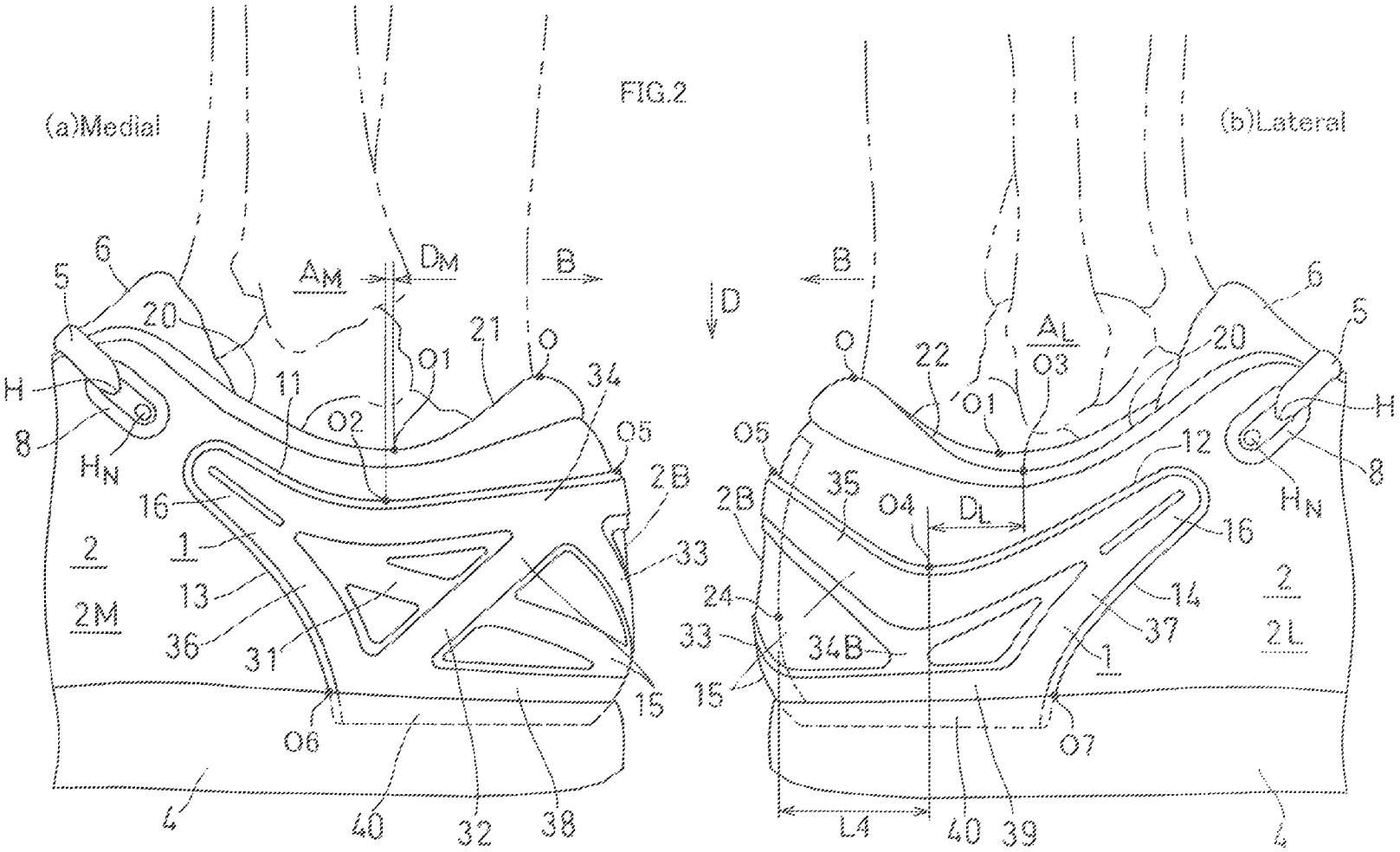

FIGS. 2(*a*) and 2(*b*) are a medial side view and a lateral side view, respectively, showing a rear foot portion of the shoe.

Figure 3:
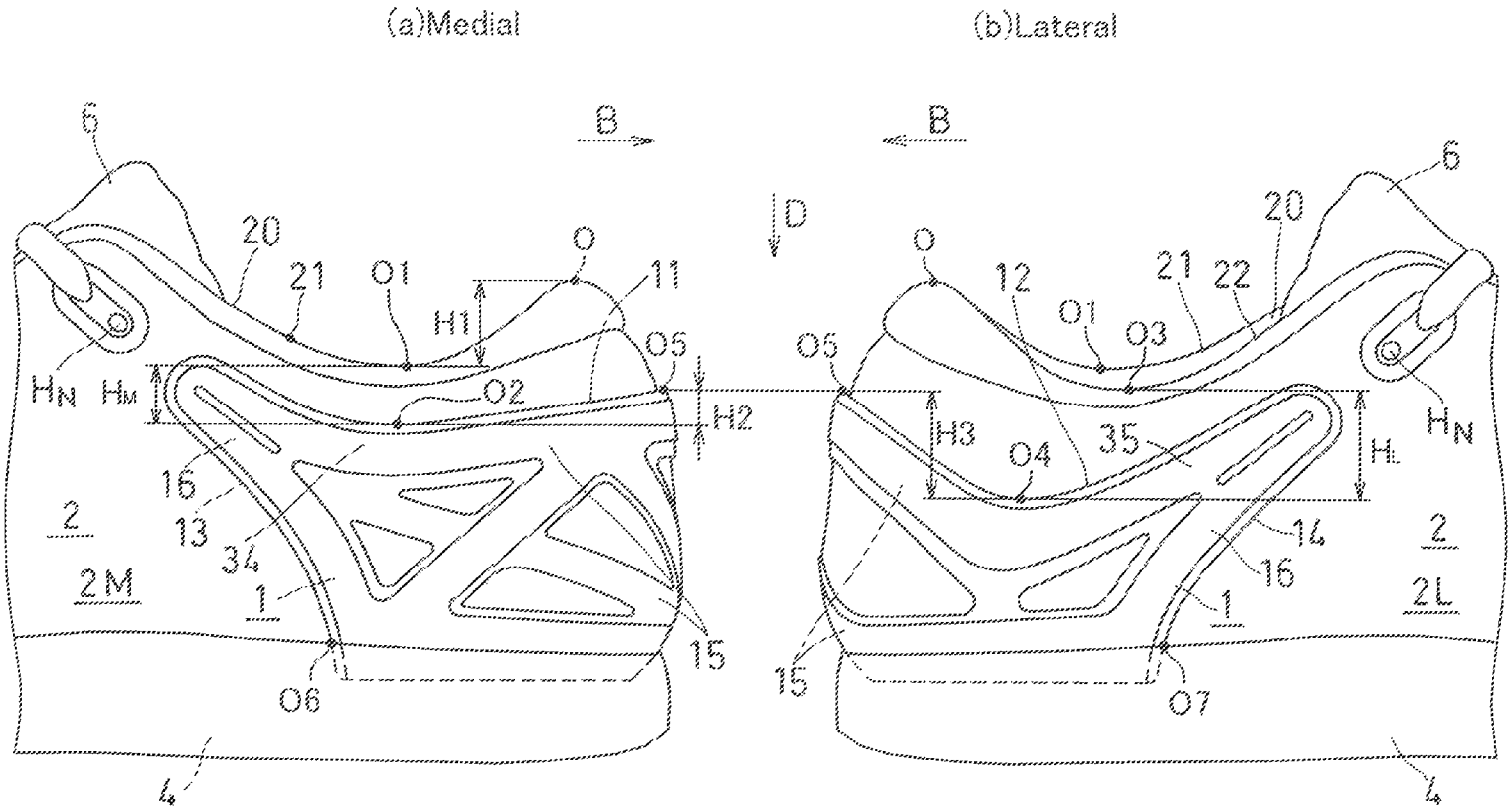

FIGS. 3(*a*) and 3(*b*) are a medial side view and a lateral side view, respectively, of the rear foot portion of the shoe.

Figure 4:
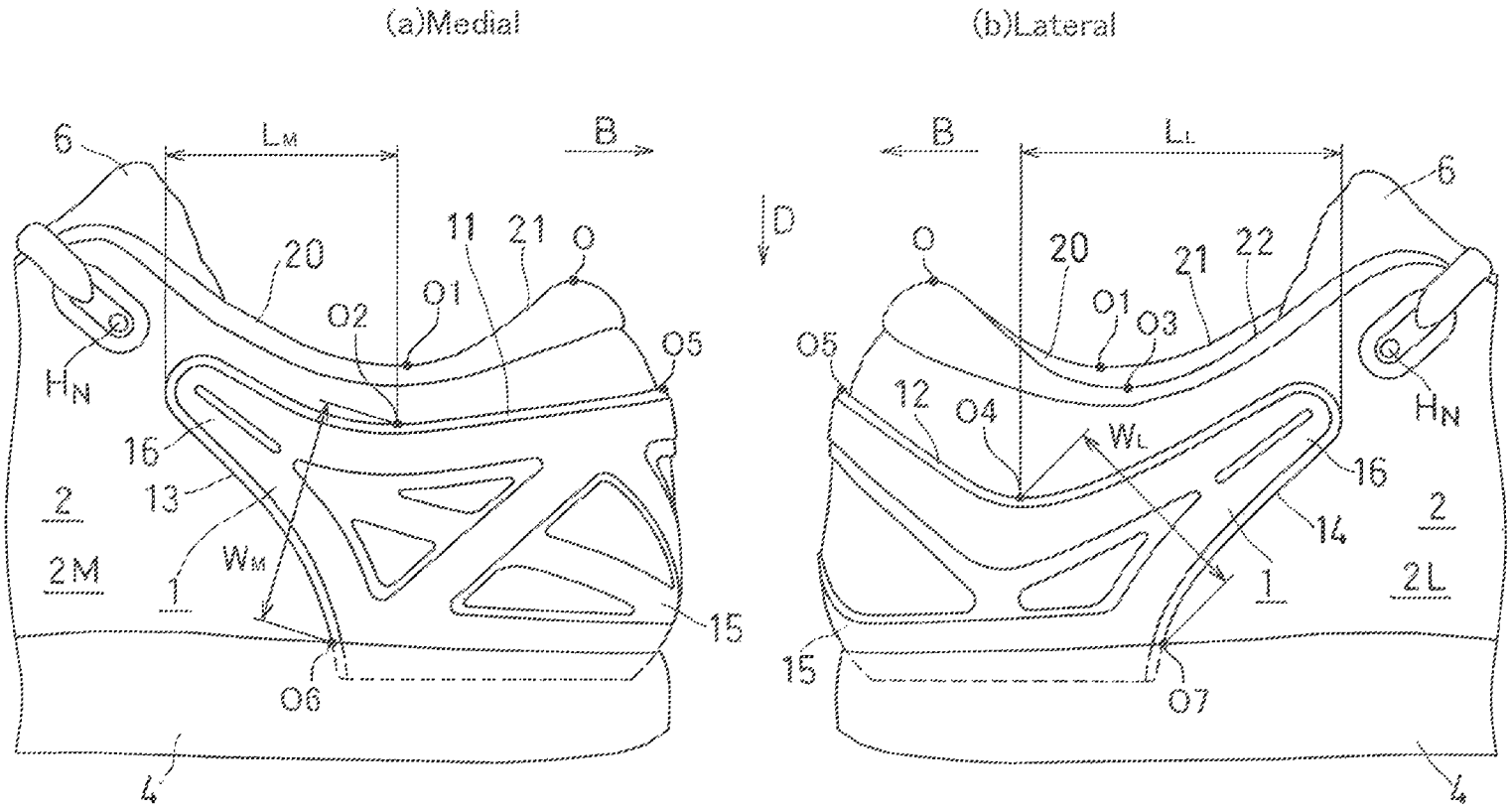

FIGS. 4(*a*) and 4(*b*) are a medial side view and a lateral side view, respectively, of the rear foot portion of the shoe.

Figure 5:
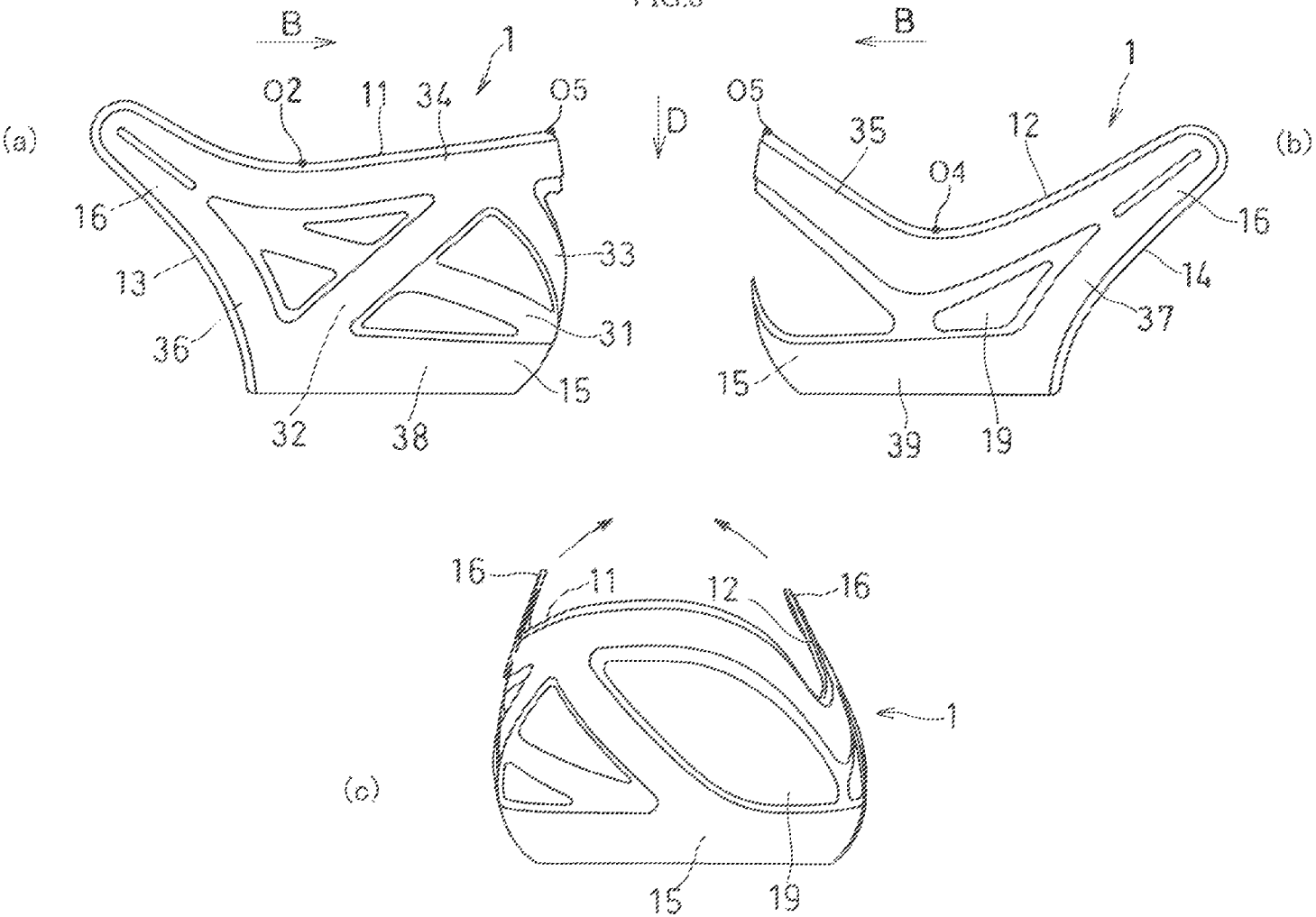

FIGS. 5(*a*), 5(*b*) and 5(*c*) are a medial side view, a lateral side view and a back view, respectively, showing the counter.

Figure 6:
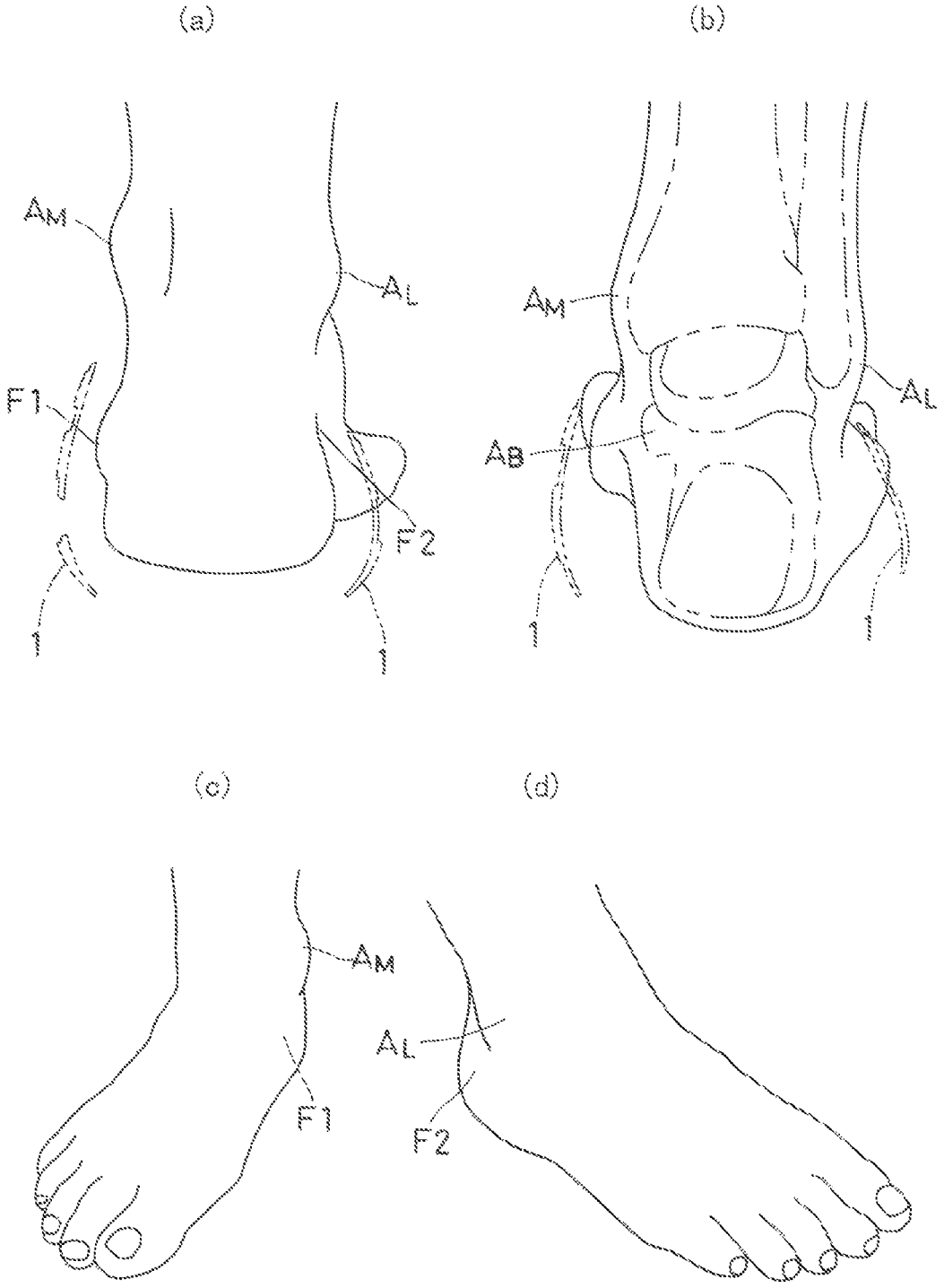

FIGS. 6(*a*) and 6(*b*) are perspective views of the foot as seen from different diagonally rearward angles, and FIGS. 6(*c*) and 6(*d*) are perspective views of the foot as seen from different diagonally forward angles.

Figure 7:
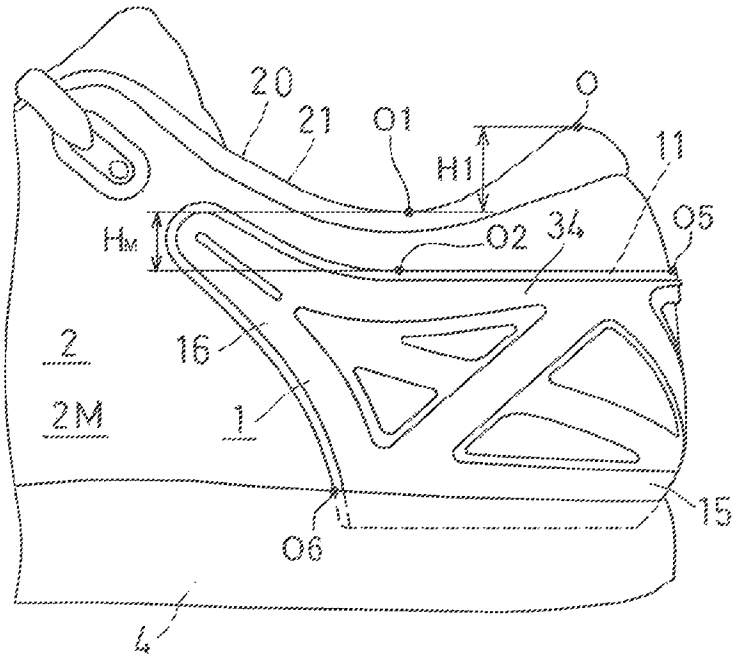
Figure 7:
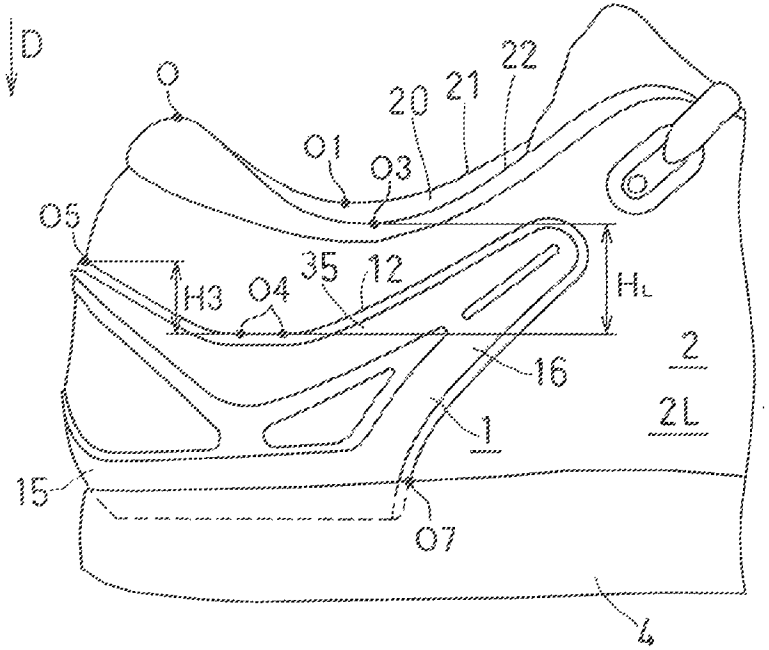

FIGS. 7(*a*) and 7(*b*) are a medial side view and a lateral side view, respectively, showing a rear foot portion of a shoe of Embodiment 2.

Figure 8:
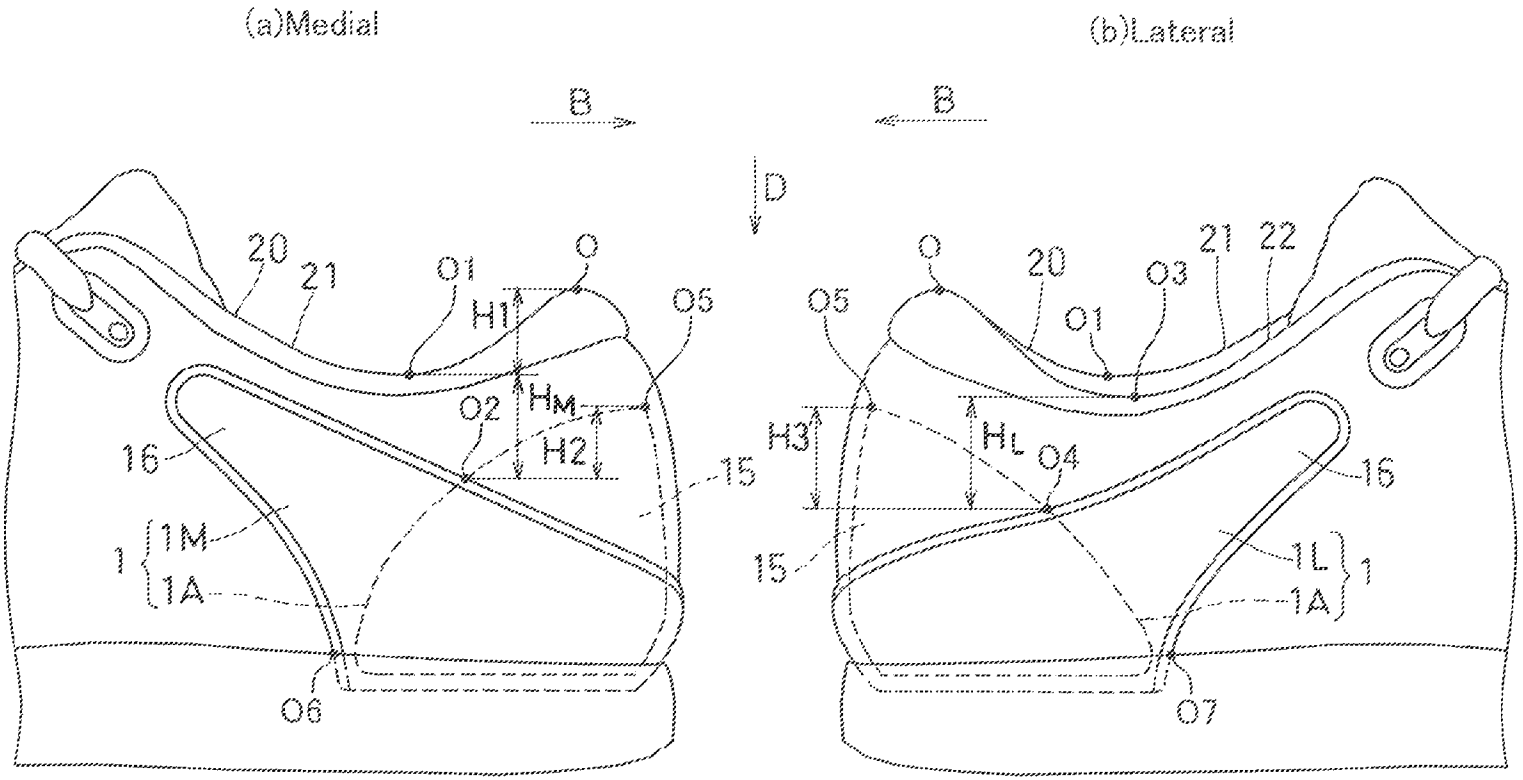

FIGS. 8(*a*) and 8(*b*) are a medial side view and a lateral side view, respectively, showing a rear foot portion of a shoe of Embodiment 3.

Figure 9:
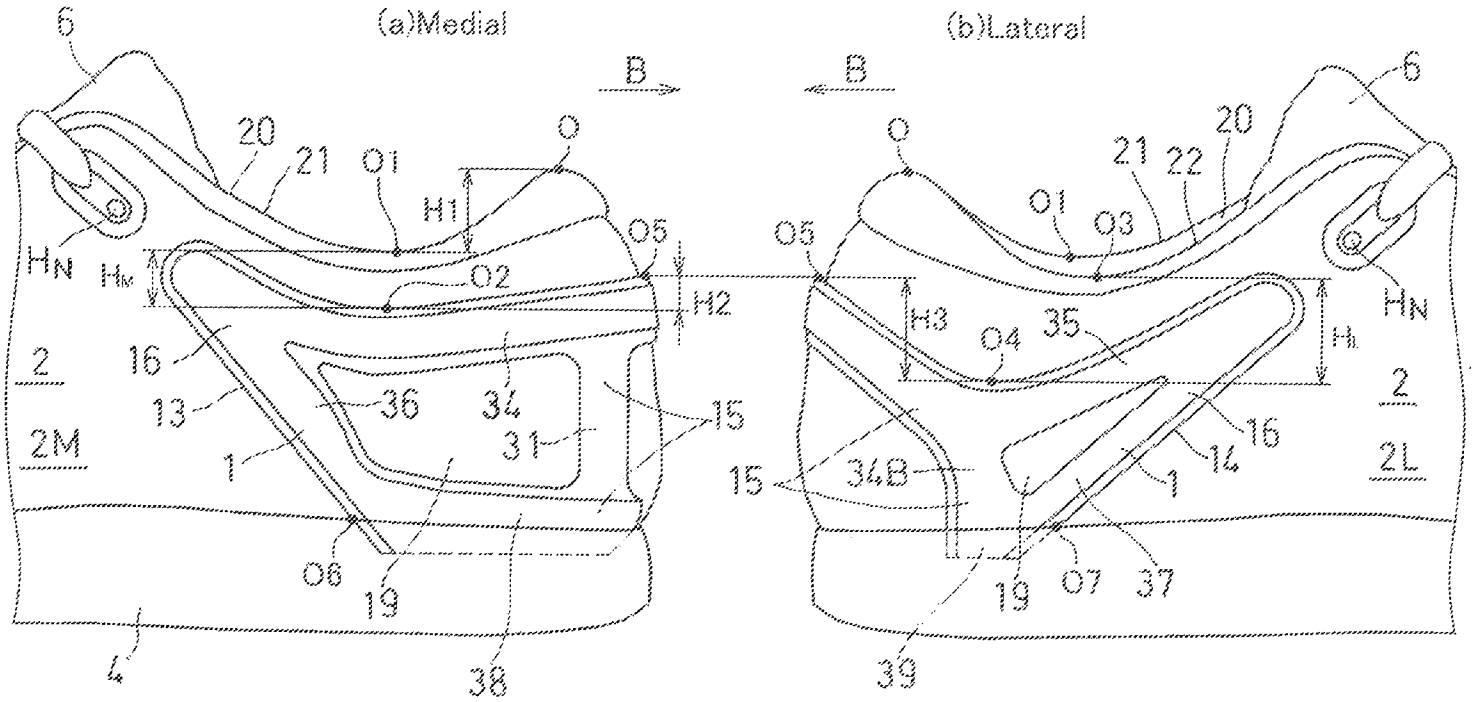

FIGS. 9(*a*) and 9(*b*) are a medial side view and a lateral side view, respectively, of a shoe of Embodiment 4.

Figure 10:
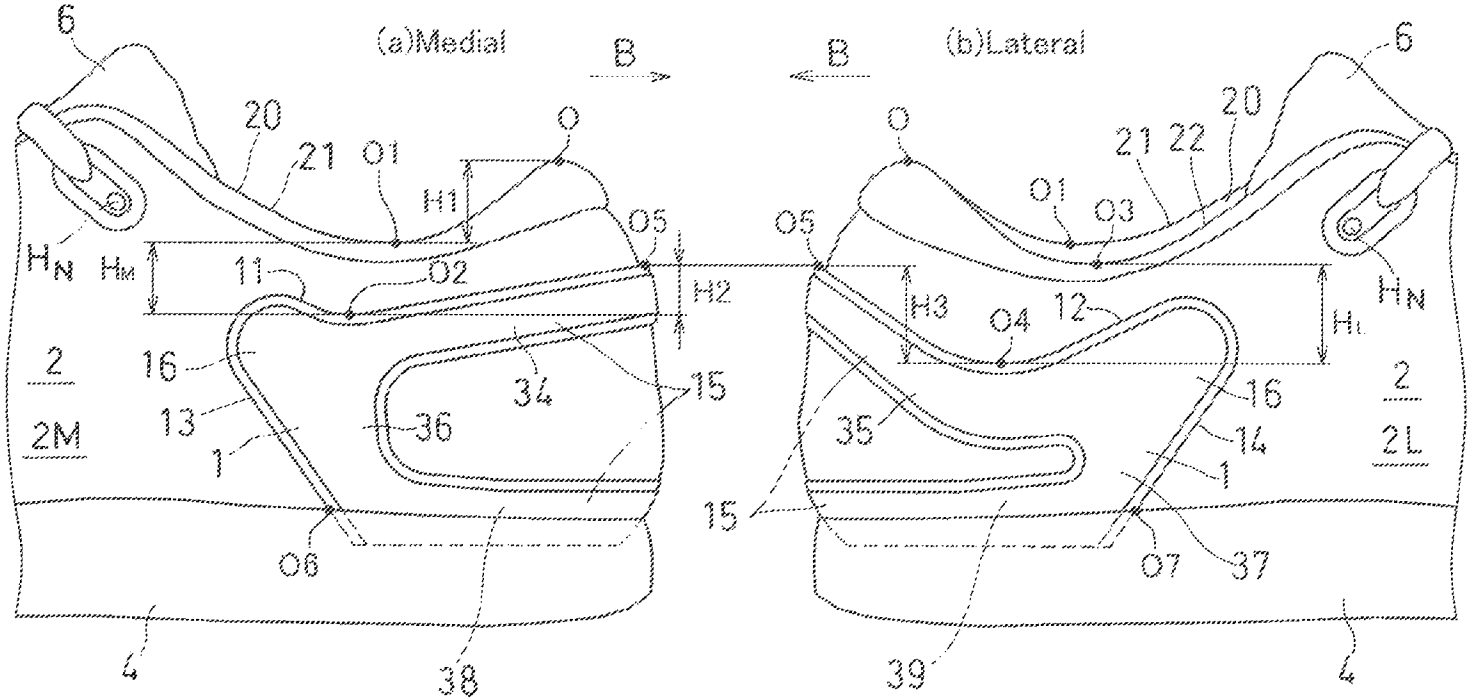

FIGS. 10(*a*) and 10(*b*) are a medial side view and a lateral side view, respectively, of a shoe of Embodiment 5.

Figure 11:
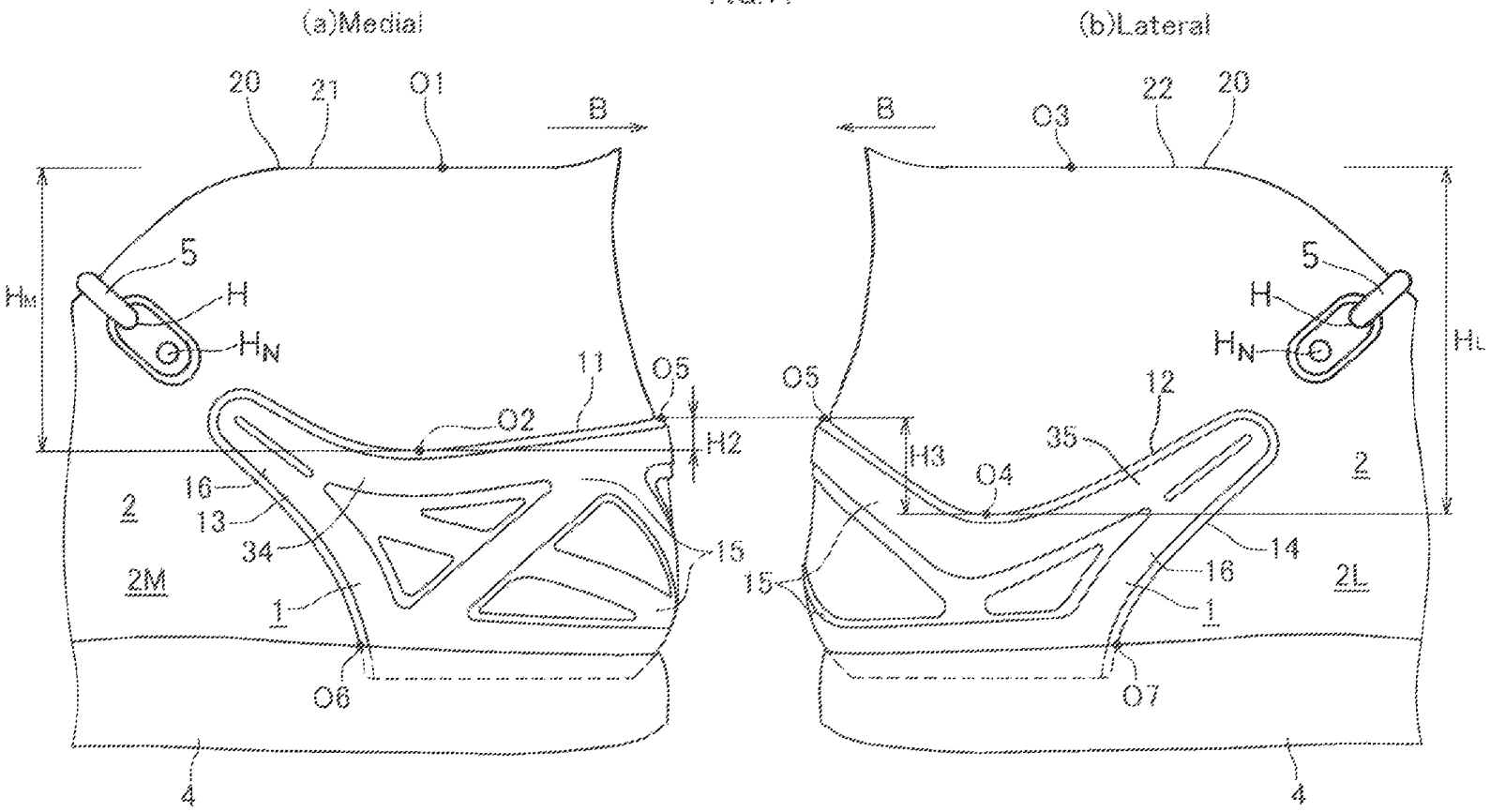

FIGS. 11(*a*) and 11(*b*) are a medial side view and a lateral side view, respectively, of a shoe of Embodiment 6.

DESCRIPTION OF EMBODIMENTS

An embodiment of the present disclosure may include one or more of the following arbitrarily-selected features.

In one example of the embodiment of the present invention, the third point O3 is arranged downward D relative to the first point O1.

In one example, the first height difference H1 is defined by the difference in the height direction from the uppermost point O on the medial line 21 on the rear end side to the first point O1. On the medial side, the second height difference H2 is defined by the difference in the height direction from the fifth point O5 on the first counter line 11 and the second counter line 12 on the rear end to the second point O2. On the lateral side, the third height difference H3 is defined by the difference in the height direction from the fifth point O5 to the fourth point O4. In this example, Expression (100) below is satisfied.

$$H3>H1>H2 \quad (100)$$

In one example, Expression (110) below is satisfied, where S denotes the size of the shoe in the front-rear direction.

$$S/100<H_L-H_M<S/10 \quad (110)$$

According to Expression (110) above, the value ($H_L$-$H_M$) is 2.7 mm to 27 mm when the size is 27 cm. The value ($H_L$-$H_M$) is 0.1 to 1.0 inch when the size is 10 inches.

Note that in the present specification, the size S of the shoe in the front-rear direction refers to the size of the shoe as sold or the size of the foot of the wearer as indicated on the tag.

In one example, the fourth point O4 of the counter 1 is arranged rearward B in the front-rear direction relative to the third point O3 of the upper 2.

In one example, the first distance $D_M$ is defined by the distance in the front-rear direction from the first point O1 to the second point O2. The second distance $D_L$ is defined by the distance in the front-rear direction from the third point O3 to the fourth point O4. In this example, the second distance $D_L$ is greater than the first distance $D_M$.

In one example, the counter 1 has a medial front end line 13 defined as extending in a diagonal forward and upward direction from the medial lower end point O6, which is the frontmost end of the counter 1 at the sole upper edge on the medial side. The counter 1 also has a lateral front end line 14 defined as extending in a diagonal forward and upward direction from the lateral lower end point O7, which is the frontmost end of the counter 1 at the sole upper edge on the lateral side.

In one example, the lateral lower end point O7 is arranged rearward B in the front-rear direction of the shoe relative to the medial lower end point O6.

In one example, the first width $W_M$ is defined by the distance from the second point O2 to the medial lower end point O6 on the medial side. The second width $W_L$ is defined by the distance from the fourth point O4 to the lateral lower end point O7 on the lateral side. In this example, the first width $W_M$ is greater than the second width $W_L$.

In one example, the shoe further includes a sole attached to the upper 2. In this example, the counter 1 includes a heel portion 15 that extends upward from the sole at a position downward of the rear portion of the topline 20 and is arranged on the medial side, the back side and the lateral side of the upper 2. The counter 1 includes a movable portion 16 on the medial side and on the lateral side that extends in a diagonal forward and upward direction from the heel portion 15 at a position downward of the front portion of the topline 20 on the medial side and on the lateral side.

In the present specification, the back side of the upper at least includes a portion of the upper on the rearmost end and includes the rear end portion on the medial side and on the lateral side, but the boundary between the medial side and lateral side is not an issue.

In one example, the fourth point O4 is arranged rearward B in the front-rear direction of the shoe relative to the second point O2.

In one example, the shoe further includes a shoelace 5 for pulling a medial portion 2M and a lateral portion 2L of the upper 2 toward each other. In this example, the medial portion 2M and the lateral portion 2L define a plurality of eyelets H with which the shoelace engages. The movable portions 16 on the medial side and the lateral side extend toward the respective rearmost eyelets $H_N$ among the eyelets of each of the medial portion 2M and the lateral portion 2L.

In one example, the first length $L_M$ is defined by the length in the front-rear direction from the second point O2 to the tip of the movable portion 16 on the medial side. The second length $L_L$ is defined by the length in the front-rear direction from the fourth point O4 to the tip of the movable portion 16 on the lateral side. In this example, the second length $L_L$ is longer than the first length $L_M$.

Any feature illustrated and/or depicted in conjunction with one of the aforementioned embodiments may be used in the same or similar form in one or more of the other embodiments, and/or may be used in combination with, or in place of, any feature of the other embodiments.

The present invention will be understood more clearly from the following description of preferred embodiments taken in conjunction with the accompanying drawings. Note however that the embodiments and the drawings are merely examples for the purpose of illustration and description and are non-limiting. The scope of the present invention shall be defined by the claims and shall include all modifications within the meaning and the scope equivalent to those claims. In the present specification, unless specifically noted otherwise, like elements are denoted by like reference signs throughout the accompanying drawings and will not be described redundantly. In the present specification, the front-rear direction is defined so that the toe side is forward F and the heel side is rearward B.

Embodiment 1

FIG. 1 to FIG. 5 show Embodiment 1. As shown in FIG. 1, the present athletic shoe includes the upper 2, the sole 4 and the counter 1.

Although not shown in the figures, the upper 2 may include a cushion material made of a foamed resin between the quarter (outer skin) and the quarter lining (inner skin).

An insole (not shown) well known in the art may be sewn to the upper 2. The upper 2 of FIG. 2 includes the topline 20 through which the leg extends upward and through which the foot is inserted. Inside the upper 2, a sock lining 7 shown in FIG. 1(*c*) is arranged on the insole.

In FIG. 1, the upper 2 includes a fastener such as the shoelace 5, for example. The shoelace 5 pulls the medial portion 2M and the lateral portion 2L toward each other so that the medial portion 2M and the lateral portion 2L of the upper 2 come into close contact with the foot, thus fastening the upper 2. The medial portion 2M and the lateral portion 2L define a plurality of eyelets H with which the shoelace 5 engages. Note that the reference sign 6 denotes a tongue provided forward of the topline 20.

The medial portion 2M of the upper 2 covers the medial surface of the foot. The lateral portion 2L of the upper 2 covers the lateral surface of the foot. The medial portion 2M and the lateral portion 2L of the upper 2 are continuous with each other on the back side 2B of the upper 2. In the present embodiment, the lateral ankle $A_L$ and the medial ankle $A_M$ are each exposed above the topline 20 as shown in FIG. 2.

In the present embodiment, as shown in FIG. 2, the counter 1 is bonded and secured to the outer surface of the upper 2 in the medial portion 2M and the lateral portion 2L of the upper 2. Thus, the upper 2 including the counter 1 bonded to the outer surface thereof has a high flexural rigidity and is likely to contribute to suppressing the eversion (the collapse of the foot toward the medial side).

The counter 1 is formed as an integral piece made of a non-foamed material including a thermoplastic resin component, for example. The counter 1 may be made of another material such as an artificial leather.

The sole 4 is layered under the counter 1 and the insole.

Next, an example of a specific structure of the counter 1 will be described. In FIG. 1, the counter 1 is dotted for the sake of illustration.

The counter 1 shown in FIG. 1 to FIG. 4 is bonded to the outer surface of a fabric of the upper 2, thereby keeping the shape of a heel portion 23 of the flexible upper 2 formed of a multi-layer fabric. The counter 1 of FIG. 1 includes the medial side arranged on the medial portion 2M and the lateral side arranged on the lateral portion 2L, which are formed as an integral piece as shown in FIG. 5(*c*).

As shown in FIG. 2, the medial side and the lateral side of the counter 1 are formed asymmetric with each other. On the medial side and on the lateral side, the counter 1 is formed in a frame shape (loop shape), including a medial beam 34, a lateral beam 35, a medial arm 36, a lateral arm 37, a medial base 38 and a lateral base 39. A plurality of through holes 19 (FIG. 1) are provided in the frame-shaped counter 1. A sheet resin, or the like, may be attached to the portions of the through holes 19 so as to protect the heel portion 23.

As shown in FIG. 2, on the medial and lateral sides (the medial side and the lateral side), the medial beam 34 and the lateral beam 35 each extend in a band shape that protrudes downward. On the medial and lateral sides, the medial base 38 and the lateral base 39 each extend in the front-rear direction of the shoe with a portion thereof sandwiched between the upper 2 and a roll-up portion 40 of the sole 4.

The medial beam 34 and the lateral beam 35 of FIG. 5 are arranged along the uppermost portion of the counter 1 and are continuous with each other on the back side. The medial base 38 and the lateral base 39 are continuous with each other on the back side.

On the medial side, the medial beam 34 and the medial base 38 of the frame-shaped counter 1 are linked to each other by first and second bridges 31 and 32. The medial beam 34 and the lateral base 39 are linked to each other by a third bridge 33 on the back side. Moreover, the lateral beam 35 and the lateral base 39 are linked to each other by a fourth bridge 34B. The first bridge 31 and the fourth bridge 34B are formed thinner than the second bridge.

The counter 1 of FIG. 2 includes the heel portion 15 and the movable portion 16. The heel portion 15 extends upward from the sole 4 at a position downward D of the rear portion of the topline 20 and is arranged on the medial side, the back side and the lateral side of the upper 2. On the medial side and the lateral side, the movable portion 16 extends in a diagonal forward and upward direction from the heel portion 15 at a position downward D of the front portion of the topline 20.

The medial and lateral movable portions 16 of FIG. 2 extend toward the respective rearmost eyelets $H_N$ among the eyelets H of each of the medial portion 2M and the lateral portion 2L. The tips of the medial and lateral movable portions 16 each extend to a position that is forward relative to the heel of the foot inserted. An eyelet piece 8 is provided for the two eyelets on the rear end side including the eyelet $H_N$. The eyelet piece 8 is formed in an oval shape and is arranged in a diagonal direction so that the direction in which the movable portion 16 extends and the direction in which the major axis of the eyelet piece 8 extends are along each other.

Next, a detailed structure of the counter 1 and the upper 2 will be described.

In FIG. 2, the topline 20 of the upper 2 is defined by the medial line 21 on the medial side and the lateral line 22 on the lateral side. In the present embodiment, the medial line 21 and the lateral line 22 are both formed as lines that protrude downward, and have the first point O1 and the third point O3 as the lowermost points thereon. Note however that the medial line 21 and the lateral line 22 are not limited to lines that protrude downward, but may be straight or curved lines that are sloped in the front-rear direction or straight lines that are not sloped.

As shown in FIG. 2(*b*), the third point O3 on the lateral side is arranged downward relative to the first point O1 on the medial side.

The upper edge of the counter 1 of FIG. 2 is defined by the first counter line 11 on the medial side and the second counter line 12 on the lateral side. The first counter line 11 and the second counter line 12 are lines of the upper edges of the medial beam 34 and the lateral beam 35, respectively, arranged at the top of the counter.

The first counter line 11 of FIG. 2 is a line that extends along the medial line 21 of the upper and protrudes downward. On the other hand, the second counter line 12 is a line that extends along the lateral line 22 of the upper and protrudes downward. The slope of the first counter line 11 extending forward from the rear end is formed more gentle than the slope of the second counter line 12 extending forward from the rear end. The second counter line 12 is curved downward more than the first counter line 11. The second counter line 12 has a portion that has a smaller radius of curvature than the first counter line 11.

The first counter line 11 and the second counter line 12 of FIG. 2 have the second point O2 and the fourth point O4, respectively, which are the lowermost points thereon. Therefore, forward of the second point O2 and the fourth point O4, the first counter line 11 and the second counter line 12 extend in a diagonal forward and upward direction, and rearward of the second point O2 and the fourth point O4, they extend in a diagonal rearward and upward direction. The distance between the medial line 21 and the first counter line 11 is generally constant, whereas the distance between the lateral line 22 and the second counter line 12 varies between forward and rearward of the fourth point O4. Specifically, the distance therebetween for the section from the fourth point O4 to the rear end of the second counter line 12 is greater than the distance therebetween for the section from the front end of the second counter line 12 to the fourth point O4. Thus, rearward of the fourth point O4, there is a larger area of the upper that is exposed and not covered by the counter.

The medial height difference $H_M$ and the lateral height difference $H_L$ shown in FIGS. 3(*a*) and 3(*b*) are defined as follows.

The medial height difference $H_M$: the difference in the height direction between the first point O1 at the lowermost point on the medial line 21 and the second point O2 at the lowermost point on the first counter line 11.

The lateral height difference $H_L$: the difference in the height direction between the third point O3 at the lowermost point on the lateral line 22 and the fourth point O4 at the lowermost point on the second counter line 12.

Note that the medial height difference $H_M$ and the lateral height difference $H_L$ are also the heights of the areas where the upper is exposed and not covered by the counter on the respective medial and lateral sides.

The lateral height difference $H_L$ is greater than the medial height difference $H_M$. Therefore, the second counter line 12 on the lateral side is arranged at a position that is more lowered downward than the first counter line 11 on the medial side.

The first height difference H1, the second height difference 112 and the third height difference H3 of FIG. 3 are defined as follows.

The first height difference H1: the difference in the height direction from the uppermost point O on the medial line 21 on the rear end side to the first point O1.

The second height difference H2: the difference in the height direction from the fifth point O5 on the first counter line 11 and the second counter line 12 on the rear end to the second point O2 on the medial side.

The third height difference H3: the difference in the height direction from the fifth point O5 to the fourth point O4 on the lateral side.

The first to third height differences H1 to H3 satisfy Expression (100) below.

$$H3>H1>H2 \quad (100)$$

That is, on the medial side of FIG. 3(*a*), the second height difference H2 of the heel portion 15 of the first counter line 11 is smaller than the first height difference H1 of the heel portion of the upper 2. Therefore, the second point O2 on the first counter line 11 is arranged at a position close to the first point O1 on the medial line 21.

On the other hand, on the lateral side of FIG. 3(*b*), the third height difference H3 of the heel portion 15 of the second counter line 12 is greater than the first height difference H1 on the medial side of FIG. 3(*a*). Therefore, the fourth point O4 on the second counter line 12 is arranged at a position away from the third point O3 on the lateral line 22.

The medial height difference $H_M$ and the lateral height difference $H_L$ of FIG. 3 satisfy Expression (110) below, where S denotes the size of the shoe in the front-rear direction.

$$S/100<H_L-H_M<S/10 \quad (110)$$

Where the size S of the shoe is 27 cm, for example, the value ($H_L$-$H_M$) obtained by subtracting the medial height difference $H_M$ from the lateral height difference $H_L$ may be set to be about 1.0 cm.

When the difference between the lateral height difference $H_L$ and the medial height difference $H_M$ is too small, there may not be obtained sufficient improvements to the various functions mentioned above.

It is preferred that the lateral height difference $H_L$ satisfies Expression (120) below with respect to the size S.

$$S/27<H_L<S/6 \quad (120)$$

When the size S of the shoe is 27 cm, for example, the lateral height difference $H_L$ may be set to be 1.0 to 4.5 cm.

It is set to such a range because the lateral height difference $H_L$ being too large deteriorates the primary function of the counter, and the lateral height difference $H_L$ being too small makes it more difficult to realize the effect of improving the foot conformity of the upper in the counter portion.

On the lateral side shown in FIG. 2(*b*), the fourth point O4 of the counter 1 is arranged rearward B in the front-rear direction of the shoe relative to the third point O3 of the upper 2. On the other hand, on the medial side shown in FIG. 2(*a*), the second point O2 of the counter 1 is arranged at a position that is generally directly below the first point O1 of the upper 2. The fourth point O4 is located rearward relative to the second point O2. Moreover, as shown in FIG. 5, the fourth point O4 is located rearward B relative to the center of the entire length of the counter 1 in the front-rear direction. On the other hand, the second point O2 may be located forward F relative to the center of the entire length of the counter 1 in the front-rear direction.

Since the first to fourth points O1 to O4 are arranged as described above, the second distance $D_L$ of FIG. 2 is greater than the first distance $D_M$. Herein, the first distance $D_M$ and the second distance $D_L$ are defined as follows.

The first distance $D_M$: the distance in the front-rear direction (the horizontal direction) from the first point O1 to the second point O2.

The second distance $D_L$: the distance in the front-rear direction (the horizontal direction) from the third point O3 to the fourth point O4.

In FIG. 2, the medial arm 36 and the lateral arm 37 of the counter 1 define the medial front end line 13 and the lateral front end line 14, respectively. The medial front end line 13 extends in a diagonal forward and upward direction from the medial lower end point O6, which is the frontmost end of the counter 1 at the sole upper edge on the medial side. The lateral front end line 14 extends in a diagonal forward and upward direction from the lateral lower end point O7, which is the frontmost end of the counter 1 at the sole upper edge on the lateral side. The medial front end line 13 and the lateral front end line 14 are formed in curved shapes that gently protrude rearward. Note that these points O6 and O7 are the intersections between the front end lines and the upper edge of the roll-up portion 40 of the sole 4.

The lateral lower end point O7 is arranged rearward B in the front-rear direction of the shoe relative to the medial lower end point O6.

The medial arm 36 extends in a diagonal upward direction so as to connect from the front end portion of the medial base 38 to the front end portion of the medial beam 34. Similarly, the lateral arm 37 extends in a diagonal upward direction so as to connect from the front end portion of the lateral base 39 to the front end portion of the lateral beam 35. That is, the arms and the beams of the medial portion and the lateral portion are connected to each other in the front end portion, and they make acute angles. Thus, the area delimited by the upper edge line of the counter (beam) and the front end line of the arm is formed so that the width thereof narrows gradually toward the front side.

In the present embodiment, the first width $W_M$ of the base portion of the medial movable portion 16 of FIG. 4(*a*) is greater than the second width $W_L$ of the base portion of the lateral movable portion 16 of FIG. 4(*b*).

Herein, the widths $W_M$ and $W_L$ are defined as follows.

The first width $W_M$: the distance from the second point O2 to the medial lower end point O6 on the medial side.

The second width $W_L$: the distance from the fourth point O4 to the lateral lower end point O7 on the lateral side.

In FIG. 4, the second length $L_L$ on the lateral side of FIG. 4(*b*) is longer than the first length $L_M$ on the medial side of FIG. 4(*a*).

Herein, the lengths $L_M$ and $L_L$ are defined as follows. The first length $L_M$: the length in the front-rear direction from the second point O2 to the tip of the movable portion 16 on the medial side.

The second length $L_L$: the length in the front-rear direction from the fourth point O4 to the tip of the movable portion 16 on the lateral side.

Where the entire length of the sock lining 7 is expressed as 100%, the fourth point O4 on the lateral side of FIG. 1(*c*) is preferably arranged at such a position that the length $L_4$ in the front-rear direction from the rear end (the position corresponding to the rear end of the sock lining as placed inside the shoe) 24 inside the upper 2 to the fourth point O4 is within 15% of the entire length. More preferably, it may be arranged at such a position that it is 5% to 15%. Note that for shoes with no sock lining, the entire length of the insole or the entire length of the inside of the shoe may be used instead.

Next, functions of the present embodiment will be described.

With athletic shoes for which the running function is important, it is preferred that the third point O3 at the lowermost point on the lateral line 22 is arranged downward relative to the first point O1 at the lowermost point on the medial line 21, as shown in FIG. 3. By arranging the first point O1 and the third point O3 as described above, it is possible to prevent the lateral line 22 from interfering with the lateral ankle, which is at a lower position than the medial ankle.

In the present embodiment, the third point O3 is arranged downward relative to the first point O1, and the fourth point O4 of the counter is arranged at a position that is more distantly downward from the third point O3. Therefore, the height from the lateral ankle to the second counter line 12 on the lateral side is large. The second counter line has a shape that protrudes downward so as to surround the periphery of the lateral ankle. This, on the lateral side, will make it more likely for the counter to conform to the lateral surface of the heel that is tapered in the upward direction. Moreover, the height of the area where the upper is exposed and not covered by the counter is large. As a result, the fit of the upper will improve on the lateral side.

In the present embodiment, in the lateral portion 2L of FIG. 3(*b*) where the second counter line 12 is arranged at a low position, the heel portion 15 is likely to conform to the lower side surface of the narrowed portion F2 on the lateral side with the movable portion 16 being pulled by the shoelace 5. Therefore, the foot conformity of the upper will improve.

On the other hand, in the present embodiment, the second point O2 of the counter is arranged at a position close to the first point O1, which is arranged upward relative to the third point O3 of FIG. 3. Therefore, the height from the medial ankle to the first counter line 11 on the medial side is small. Therefore, the sustentaculum tali $A_B$, which is bulging on the medial side, etc., are covered by the counter, thereby realizing an enhanced function of suppressing pronation in which the foot collapses toward the medial side.

In the present embodiment, in the medial portion 2M where the first counter line 11 of FIG. 3 is arranged at a high position, it is easy, with the movable portion 16 pulled by the shoelace 5 and the heel portion 15, to suppress collapse of the foot toward the medial side.

In the present embodiment, the second height difference H2 on the medial side of the counter is smaller than the first height difference H1 of the upper. Therefore, on the medial side, the first counter line 11 can be close to the first point O1 at the lowermost point on the medial line 21 of the upper. Therefore, it will be even easier to suppress pronation in which the foot collapses toward the medial side.

In the present embodiment, the third height difference H3 on the lateral side of the counter is greater than the first height difference H1 of the upper. Therefore, on the lateral side, the second counter line 12 can be distant downward from the third point O3 at the lowermost point on the lateral line 22 of the upper. In other words, the fourth point O4 on the second counter line 12 is arranged at a position away from the third point O3 on the lateral line 22. Therefore, downward of the narrowed portion F2 on the lateral side, the counter is likely to conform to the lateral side surface of the heel.

In the present embodiment, since the fourth point O4 at the lowermost point of the counter on the lateral side is arranged rearward of the third point O3 at the lowermost point of the upper, the fourth point O4 of the counter is arranged rearward relative to the lateral ankle $A_L$. Therefore, it is even more likely for the counter on the lateral side to conform to the narrow portion toward the rear end of the heel.

In the present embodiment, the fourth point O4 is arranged rearward relative to the third point O3. The second distance $D_L$ is greater than the first distance $D_M$. Therefore, the foot conformity of the upper will further improve on the lateral side.

In the present embodiment, the counter 1 has front end lines each extending in a diagonal forward and upward direction. Since areas delimited by the lines of the upper edge of the counter 1 and the front end lines 13 and 14 of the arms 36 and 37 are each formed so that the width thereof narrows gradually toward the front side, it is possible to realize the shape-keeping property of the bases 38 and 39 of the counter 1, and it is made more likely for the upper to be pulled up by the shoelace, or the like. As a result, the foot conformity, etc., of the counter will improve, thereby improving various functions mentioned above of the counter. Since the medial front end line 13 and the lateral front end line 14 are formed in curved shapes that gently protrude rearward, local deformations in the arms 36 and 37 are unlikely to occur when the shoe is worn.

In the present embodiment, since the sixth point O6 on the medial side is arranged forward of the seventh point O7 on the lateral side, the base portion supporting the counter on the medial side is long, and it is therefore easier to suppress collapse of the counter toward the medial side. If a portion of the base portion is sandwiched between the upper 2 and the roll-up portion 40 of the sole 4, it will be possible to more effectively suppress collapse of the medial side. Thus, the pronation-suppressing function will further improve.

On the other hand, since the seventh point O7 on the lateral side is arranged rearward relative to the sixth point O6 on the medial side, the base portion that supports the counter on the lateral side is short. Therefore, the counter is likely to conform to the foot on the lateral side. Therefore, the foot conformity of the upper will further improve.

In the present embodiment, the first width $W_M$ is greater than the second width $W_L$. Therefore, portions (the movable portions 16) of the counter that extend in a diagonal forward and upward direction along the front end lines 13 and 14 are movable about the base extending from the second point O2 to the sixth point O6 on the medial side and about the base extending from the fourth point O4 to the seventh point O7 on the lateral side.

Herein, in the present embodiment, the first width $W_M$ on the medial side is greater than the second width $W_L$ on the lateral side, and the movable portion 16 on the medial side is less movable. Therefore, it will be easy to suppress collapse of the foot when the foot is urged to collapse toward the medial side.

For example, the heel portion 15 on the medial side, which has the large first width $W_M$, of FIG. 4(*a*) will support the medial side up to a higher position, and will more easily suppress collapse of the foot toward the medial side. Moreover, since the first bridge 31 and the second bridge 32 are arranged in an X-letter shape, deformation of the medial side of the counter 1 will be suppressed. In this case, if the first bridge 31 is formed thinner than the second bridge 32, it will be possible to decrease the weight of the counter 1 while suppressing deformation.

On the other hand, the second width $W_L$ on the lateral side is smaller than the first width $W_M$ on the medial side, and the movable portion 16 on the lateral side is more movable. Therefore, the movable portion 16 is easily pulled by a shoelace, or the like, and the counter is more likely to conform to the foot.

That is, the movable portion 16 on the lateral side, which has the small second width $W_L$, of FIG. 4(*b*) has a small flexural rigidity, and it will easily deform toward the center between the medial and lateral sides as indicated by arrows in FIG. 5(*c*). Therefore, the foot conformity of the upper will improve. Moreover, the fourth bridge 34B of FIG. 2(*b*) extends from the vicinity of the fourth point O4 toward the lateral base 39, and it ensures a strength in the vicinity of the fourth point while improving the foot conformity in the lateral portion. In this case, if the fourth bridge 34B is formed thinner than other bridges, it will be possible to decrease the weight of the counter 1 while ensuring a strength.

In the present embodiment, the heel portion 15 will exert the stability and the holding function mentioned above. On the other hand, the movable portion 16 will improve the foot conformity of the upper to the heel. The heel portion 15 and the movable portion 16 in cooperation with each other will exert the pronation-suppressing function.

In the present embodiment, as shown in FIG. 2, the medial and lateral movable portions 16 extending toward the rearmost eyelets will be pulled by the shoelace 5 so as to conform the upper to the foot forward of the ankle. Particularly, when the direction in which the movable portion 16 extends and the direction in which the major axis of the eyelet piece 8 extends are along each other, it will further improve the foot conformity of the movable portion on the medial and lateral sides of the foot.

In the present embodiment, with the second length $L_L$ of each movable portion 16 of FIG. 4 being greater than the first length $L_M$, the movable portion 16 on the lateral side is also diagonally longer than the movable portion 16 on the medial side.

Therefore, with this in combination with the flexural rigidity being small as described above, the movable portion 16 on the lateral side is likely to conform to the shape of the lateral side of the foot, and will further improve the foot conformity of the upper on the lateral side.

On the other hand, as the fourth point O4 is set at a position within 15% from the rear end of the entire length of the sock lining as in the present embodiment, the fourth point O4 is located rearward B relative to the rear end of the lateral ankle $A_L$ of the foot inserted in the shoe, and the foot conformity of the upper will improve.

Embodiment 2

FIG. 7 shows Embodiment 2. Note that the description hereinbelow will focus on what is different from Embodiment 1 described above, and redundant description will not be repeated. In the present embodiment, the second point O2 and the fourth point O4 at the lowermost points on the counter lines 11 and 12 appear to be linear. Note that in the present embodiment, the value of the second height difference H2 (FIG. 3) is zero.

For example, on the medial side of FIG. 7(*a*), the first counter line 11, i.e., the upper edge of the medial beam 34, is at the same height from the second point O2 to the fifth point O5 at the rear end. On the other hand, on the lateral side of FIG. 7(*b*), the upper edge of the lateral beam 35 of the second counter line 12 is at the same height between two fourth points O4 and O4.

In the present embodiment, while the position in the front-rear direction of the second point O2 of FIG. 7(*a*) may be regarded as being any position from the second point O2 to the fifth point O5 shown in FIG. 7, it is preferably regarded as being the forwardmost position on the first counter line 11 as shown in FIG. 7. This is because the second point O2 is arranged at a high position on the medial side with the aim of realizing the function such that the present counter suppresses collapse of the medial side.

In the present embodiment, while the position in the front-rear direction of the fourth point O4 of FIG. 7(*b*) may be regarded as being any position from one fourth point O4 to the other fourth point O4 shown in FIG. 7, it is preferably regarded as being the forwardmost position on the second counter line 12. This is because the fourth point O4 is arranged at a high position on the lateral side with the aim of improving, with the present counter, the foot conformity of the upper rear end portion on the lateral side.

In the present embodiment, since the lowermost points on the first and second counter lines 11 and 12 can each be realized as a wide range, it is possible to provide shoes that can accommodate various users with different heel positions.

Note that in the present embodiment, the third height difference H3 of FIG. 7(*b*) is smaller than the first height difference H1 of FIG. 7(*a*).

Embodiment 3

FIG. 8 shows Embodiment 3. Note that the description hereinbelow will focus on what is different from Embodiments 1 and 2 described above, and redundant description will not be repeated. In the present embodiment, the heel portion 15 of the counter 1 is built in the upper 2, and an external counter 1 including the movable portion 16 of the counter 1, etc., is provided. The upper edge line of the external counter 1 is formed as a slope whose height lowers gradually while extending from front to rear.

A built-in counter 1A forming the heel portion 15 is formed in a hemisphere shape as seen from the back such that it lowers gradually while extending forward from the fifth point O5 at the rear end.

In the present embodiment, the second point O2 of FIG. 8(*a*) is defined as the intersection between the built-in counter 1A and an external counter 1M on the medial side. On the other hand, the fourth point O4 of FIG. 8(*b*) is defined as the intersection between the built-in counter 1A and an external counter 1L on the lateral side.

Note that the shape of the external counter and the shape of the built-in counter may be switched around, or these members may both be externally provided on the upper. In the present embodiment, it is possible to simplify the shape of the counter.

Embodiment 4

FIG. 9 shows Embodiment 4. Note that the description hereinbelow will focus on what is different from Embodiments 1 to 3 described above, and redundant description will not be repeated. In the present embodiment, the lateral base 39 is shorter in the front-rear direction than in the embodiments described above. Note that the lateral base 39 may be absent.

The front end lines 13 and 14 of the medial and lateral arms 36 and 37 may extend straight in a diagonal front-rear direction.

There may be one each of the medial and lateral bridges. For example, on the medial side, the first bridge 31 may be provided so as to bridge between the medial beam 34 and the medial base 38 in the up-down direction. The first bridge 31 may be formed thinner than the medial beam 34 and the medial base 38.

On the other hand, on the lateral side, the fourth bridge 34B may be provided so as to bridge between the lateral arm 35 and the lateral base 39 in the up-down direction. The fourth bridge 34B may be formed with the same thickness as the lateral arm 35 and the lateral base 39.

Note that the through holes 19 may be absent.

In the present embodiment, the strength of the heel portion 15 can be set to be weaker than in other embodiments, and it is therefore possible to give the shoe a cushioning property upon landing.

Embodiment 5

FIG. 10 show Embodiment 5. Note that the description hereinbelow will focus on what is different from Embodiments 1 to 4 described above, and redundant description will not be repeated. In the present embodiment, the counter 1 has the same shape and structure on the medial side and on the lateral side except for the medial beam 34 and the lateral beam 35 having different shapes from each other. The present embodiment is applicable to shoes having an upper with a higher strength than in other embodiments, etc.

In the present embodiment, the bridge is absent. The medial and lateral through holes 19 may be formed as one continuous through hole on the back side. This is because the upper itself has a high strength.

The movable portions 16 are shorter than those of other embodiments described above. Moreover, the movable portions 16 may be absent as long as the counter lines 11 and 12 protrude downward.

The sixth point O6 and the seventh point O7 may be at the same position in the front-rear direction.

In the present embodiment, it is possible to give the shoe an even better cushioning property upon landing than in Embodiment 4.

Embodiment 6

FIG. 11 shows Embodiment 6. Note that the description hereinbelow will focus on what is different from Embodiments 1 to 5 described above, and redundant description will not be repeated. In the present embodiment, the upper 2 is of a middle-cut or high-cut type, and the medial portion 2M covers the medial ankle and the lateral portion 2L covers the lateral ankle.

The medial line 21 and the lateral line 22 extend in the horizontal direction. Therefore, the first point O1 and the third point O3 may each be set at any point on the lines 21 and 22.

In the present embodiment, the first point O1 on the medial line 21 and the third point O3 on the lateral line 22 may be set at the same height, or one may set to be higher than the other. In the present embodiment, it is possible to realize similar effects to those of the other embodiments with shoes of a middle-cut or high-cut type.

While the counter 1 is externally provided on the upper 2 in Embodiments 1, 2 and 4 to 6 described above, the counter may be built in the upper. For example, the counter may be arranged between the quarter (outer material) and the quarter lining (inner material) of the upper.

In each of the embodiments described above, the counter may be divided in two between the medial side and the lateral side at the rear end of the upper. For example, in the case of FIG. 8, the counter 1 may be divided into three, i.e., the built-in counter 1A, the external counter 1M and the external counter 1L.

Note that in such a case, the divided counter pieces may be formed of different materials. There may be a gap in the width direction of the foot at the heel center between the medial and lateral divided counter pieces.

For example, the counter of FIG. 2 may have a shape only with the arms 36 and 37 and the beams 34 and 35 and without the bases 38 and 39 and/or the bridges 31 to 33 and 34B. The counter may have slight gaps between the beams 34 and 35 and the movable portions 16 and 16 instead of having the arms or the beams seamlessly formed as an integral piece. The movable portions 16 may be formed thinner than the other portions of the counter. The lengths of the movable portions may be the same or different on the medial side and on the lateral side. For portions other than the first counter line 11 and the second counter line 12, the shape may be symmetric between the medial side and the lateral side. The rearmost eyelets $H_N$ may be formed integral with the movable portions 16.

The sole arranged under the upper may have a so-called outsole and/or midsole.

If the counter is of a built-in type, the counter may be a cardboard or a paperboard impregnated with a resin, as well as a thermoplastic resin.

While preferred embodiments have been described above with reference to the drawings, various obvious changes and modifications will readily occur to those skilled in the art upon reading the present specification.

As for any reference to numbers, quantities, etc., in the embodiments described above, the present invention is not limited to those numbers, quantities, etc., unless specified otherwise. In the embodiments, individual components may not be essential to the present invention, unless specified otherwise. Thus, such variations and modifications shall fall within the scope of the present invention as defined by the appended claims.

Effects of Embodiments

According to the embodiments, it is possible, with the counter, to stably support and hold the medial side of the foot and the lateral side of the foot.

It is also possible, with the counter on the medial side, to suppress collapse of the medial side of the foot, thereby improving the pronation-suppressing function.

Moreover, with the counter on the lateral side, the upper is likely to conform to the lateral side of the foot, thereby improving the foot conformity of the upper to the heel.

INDUSTRIAL APPLICABILITY

The present invention is applicable to athletic shoes such as running shoes and also to various other types of shoes such as walking shoes.

REFERENCE SIGNS LIST

1: Counter, 1A: Built-in counter, 1M, 1L: External counter, 11: First counter line, 12: Second counter line, 13: Medial front end line, 14: Lateral front end line, 15: Heel portion, 16: Movable portion, 19: Through hole 2: Upper, 2M: Medial portion, 2L: Lateral portion, 2B: Back side 20: Topline, 21: Medial line, 22: Lateral line, 23: Heel portion, 24: Rear end 31 to 33, 34B: First to fourth bridges, 34: Medial beam, 35: Lateral beam 36: Medial arm, 37: Lateral arm, 38: Medial base, 39: Lateral base 4: Sole, 40: Roll-up portion 5: Shoelace, 6: Tongue, 7: Sock liner, 8: Eyelet piece O1 to O7: First to seventh points $A_B$: Calcaneus bulge, $A_M$: Medial ankle, $A_L$: Lateral ankle, F1: Portion, F2: Narrowed portion $D_M$: First distance, $D_L$: Second distance $W_M$: First width, $W_L$: Second width $H_M$: Medial height difference, $H_L$: Lateral height difference $L_M$: First length, $L_L$: Second length B: Rearward, D: Downward, F: Forward

The invention claimed is:

1. A shoe comprising:

an upper, wherein an upper edge of a topline is defined by a medial line and a lateral line; and a counter, wherein an upper edge is defined, at a position downward of the upper edge of the topline, by a first counter line on a medial side and a second counter line on a lateral side, wherein:

a medial height difference is defined by a difference in a height direction between a first point at a lowermost point on the medial line and a second point at a lowermost point on the first counter line;

a lateral height difference is defined by a difference in the height direction between a third point at a lowermost point on the lateral line and a fourth point at a lowermost point on the second counter line;

the lateral height difference is greater than the medial height difference; and the fourth point of the counter is arranged rearward in a front-rear direction of the shoe relative to the third point of the upper.

2. The shoe according to claim 1, wherein the third point is arranged downward relative to the first point.

3. The shoe according to claim 1, wherein:

a first height difference is defined by a difference in the height direction from an uppermost point of a rear end side on the medial line to the first point;

on the medial side, a second height difference is defined by a difference in the height direction from a fifth point on a rear end of the first counter line and the second counter line to the second point;

on the lateral side, a third height difference is defined by a difference in the height direction from the fifth point to the fourth point; and a first expression below is satisfied:

$$H3>H1>H2$$

where H1 denotes the first height difference, H2 denotes the second height difference, and H3 denotes the third height difference.

4. The shoe according to claim 1, wherein an expression below is satisfied:

$$S/100<H_L-H_M<S/10$$

where S denotes a size of the shoe in the front-rear direction, $H_L$ denotes the lateral height difference, and $H_M$ denotes the medial height difference.

5. The shoe according to claim 1, wherein:

a first distance is defined by a distance in a front-rear direction from the first point to the second point;

a second distance is defined by a distance in the front-rear direction from the third point to the fourth point; and the second distance is greater than the first distance.

6. The shoe according to claim 2, wherein:

a first height difference is defined by a difference in the height direction from an uppermost point of a rear end side on the medial line to the first point;

on the medial side, a second height difference is defined by a difference in the height direction from a fifth point on a rear end of the first counter line and the second counter line to the second point;

on the lateral side, a third height difference is defined by a difference in the height direction from the fifth point to the fourth point; and an expression below is satisfied:

$$H3>H1>H2$$

where H1 represents the first height difference, H2 represents the second height difference, and H3 represents the third height difference.

7. The shoe according to claim 2, wherein an expression below is satisfied:

$$S/100<H_L-H_M<S/10$$

where S denotes a size of the shoe in a front-rear direction, $H_L$ denotes the lateral height difference, and $H_M$ denotes the medial height difference.

8. The shoe according to claim 3, wherein a second expression below is satisfied:

$$S/100<H_L-H_M<S/10$$

where S denotes a size of the shoe in a front-rear direction, $H_L$ denotes the lateral height difference, and $H_M$ denotes the medial height difference.

9. The shoe according to claim 2, wherein the fourth point of the counter is arranged rearward in a front-rear direction of the shoe relative to the third point of the upper.

10. The shoe according to claim 3, wherein the fourth point of the counter is arranged rearward in a front-rear direction of the shoe relative to the third point of the upper.

11. A shoe comprising:

an upper, wherein an upper edge of a topline is defined by a medial line and a lateral line; and a counter, wherein an upper edge is defined, at a position downward of the upper edge of the topline, by a first counter line on a medial side and a second counter line on a lateral side, wherein:

a medial height difference is defined by a difference in a height direction between a first point at a lowermost point on the medial line and a second point at a lowermost point on the first counter line;

a lateral height difference is defined by a difference in the height direction between a third point at a lowermost point on the lateral line and a fourth point at a lowermost point on the second counter line;

the lateral height difference is greater than the medial height difference;

the counter has a medial front end line defined as extending in a diagonal forward and upward direction from a medial lower end point, which is a frontmost end of the counter at an upper edge of a sole of the shoe on the medial side; and the counter has a lateral front end line defined as extending in the diagonal forward and upward direction from a lateral lower end point, which is a frontmost end of the counter at an upper edge of the sole of the shoe on the lateral side.

12. The shoe according to claim 11, wherein the lateral lower end point is arranged rearward in a front-rear direction of the shoe relative to the medial lower end point.

13. The shoe according to claim 11, wherein:

a first width is defined by a distance from the second point on the medial side to the medial lower end point; and a second width is defined by a distance from the fourth point on the lateral side to the lateral lower end point, wherein the first width is greater than the second width.

14. The shoe according to claim 11, wherein the counter includes:

a heel portion that extends upward from the sole at a position downward of a rear portion of the topline and is arranged on the medial side, a back side and the lateral side of the upper; and movable portions on the medial side and on the lateral side extending in a diagonal forward and upward direction from the heel portion at a position downward of a front portion of the topline on the medial side and on the lateral side.

15. The shoe according to claim 11, wherein the third point at the lowermost point is arranged downward relative to the first point at the lowermost point, and the lateral height difference is greater than the medial height difference.

16. The shoe according to claim 15, wherein the fourth point is arranged rearward relative to the second point.

17. The shoe according to claim 14, wherein:

the shoe further comprises a shoelace for pulling a medial portion and a lateral portion of the upper toward each other;

the medial portion and the lateral portion define a plurality of eyelets with which the shoelace engages; and the movable portions on the medial side and the lateral side extend toward respective rearmost eyelets among the eyelets of the medial portion and the lateral portion.

18. The shoe according to claim 14, wherein:

a first length is defined by a length in a front-rear direction from the second point to a tip of the movable portion on the medial side; and a second length is defined by a length in the front-rear direction from the fourth point to a tip of the movable portion on the lateral side, wherein the second length is longer than the first length.

19. A shoe comprising:

an upper defining a topline including a medial line and a lateral line; and a counter, wherein an upper edge is defined, at a position downward of an upper edge of the topline, by a first counter line on a medial side and a second counter line on a lateral side, wherein:

a lowermost point on the second counter line is arranged downward relative to a lowermost point on the first counter line;

the lateral line of the upper has a lowermost point of the lateral line; and the lowermost point on the second counter line is arranged rearward in a front-rear direction of the shoe relative to the lowermost point of the lateral line.

* * * * *